US005150976A

United States Patent [19]

Hilkenmeier et al.

[11] Patent Number: 5,150,976

[45] Date of Patent: Sep. 29, 1992

[54] MATRIX PRINTING HEAD WITH FORWARD AND RETURN ARTICULATED-ARMATURE MAGNETS

[75] Inventors: Jurgen Hilkenmeier, Paderborn; Hans-Werner Volke, Salzkotten, both of Fed. Rep. of Germany

[73] Assignee: Siemens-Nixdorf Informationssysteme AG, Paderborn, Fed. Rep. of Germany

[21] Appl. No.: 615,197

[22] Filed: Nov. 19, 1990

Related U.S. Application Data

[63] Continuation-in-part of Ser. No. 272,680, Nov. 7, 1988, Pat. No. 4,988,223.

[30] Foreign Application Priority Data

May 8, 1987 [DE] Fed. Rep. of Germany ..... 3715304
May 7, 1988 [WO] PCT Int'l Appl. ..... EP88/00393

[51] Int. Cl.[5] ..... B41J 2/27
[52] U.S. Cl. ..... 400/124; 101/93.05
[58] Field of Search ..... 400/124, 157.2; 101/93.05, 93.29; 335/274, 275, 220, 266, 267, 268

[56] References Cited

U.S. PATENT DOCUMENTS

| | | | |
|---|---|---|---|
| 409,675 | 8/1889 | Field | 335/266 |
| 3,900,094 | 8/1975 | Larsen et al. | 400/124 |
| 4,244,658 | 1/1981 | Mori | 400/124 |
| 4,522,122 | 6/1985 | Mazumder | 101/93.02 |
| 4,852,481 | 8/1989 | Kobryn et al. | 101/93.29 |
| 4,988,223 | 1/1991 | Hilkenmeier et al. | 400/124 |

FOREIGN PATENT DOCUMENTS

| | | | |
|---|---|---|---|
| 109660 | 5/1987 | Japan | 400/124 |
| 6916437 | 5/1970 | Netherlands | 400/124 |

*Primary Examiner*—Edgar S. Burr
*Assistant Examiner*—Ren Yan
*Attorney, Agent, or Firm*—Sprung, Horn, Kramer & Woods

[57] ABSTRACT

An electromagnetic drive mechanism for a pin in a matrix printing head has a first magnet with an articulated armature, wherein a free end of the armature acts on the pin and can be returned to a disengaaged position by a recovery mechanism. The recovery mechanism comprises another articulated-armature magnet with an armature identical with that of the first magnet but with a yoke mounted on a side of the armature that faces away from a yoke of the first magnet.

3 Claims, 2 Drawing Sheets

MATRIX PRINTING HEAD WITH FORWARD AND RETURN ARTICULATED-ARMATURE MAGNETS

The present application is a continuation-in-part application of application Ser. No. 272,680 filed Nov. 7, 1988 and now U.S. Pat. No. 4,988,223, issued on Jan. 29, 1991.

BACKGROUND OF THE INVENTION

The invention concerns an electromagnetic drive mechanism for the pin in a matrix printing head that has a magnet with an articulated armature, whereby the free end of the armature acts on the pin and can be returned to its disengaged position by a recovery mechanism.

German as 1 817 848 discloses a printing-pin magnet with electromagnetic attraction and repulsion. This device, however, requires two complete separate magnet systems, each with its own armature.

The combined mass of the two armatures decelerates operation. Also necessary is a spring to establish the armature's disengaged position, and the spring must also be activated during attraction, using up additional energy during the period and decelerating the attraction.

A system of articulated-armature magnets for a line printer with an electromagnetic recuperating magnet is known from German GM 1 923 036. Its armature is in the form of a bent lever, one arm of which has a hammer mounted on it and the other arm of which constitutes the actual armature. The end of the armature is wider, and the pole surfaces of the magnets, which are positioned on each side, are at an angle to each other, which makes the mechanism complicated to assemble. Since the armature is several times larger than any of its magnetically active regions, it operates much more slowly than a simple magnet.

German 3 139 502 C2 discloses a rapid-excitation circuit for printing magnet along with circuitry for intercepting the turn-off current with a buffer capacitor, whereby the temporarily stored capacitor charge flows later, once the magnet has been completely drained of current, through the same coil in the opposite direction, resulting in combination with a permanent magnet in the armature circuit in a recovery action. This design depends in its function on many components and their tolerances.

A matrix printing head with an armature that is turned and milled from a ferromagnetic blank is known from German 2 201 049 B2. Although the ends of the armature are in the same plane, they can be aligned in that plane only by turning and not by lapping because of the presence of an elevated edge with a groove for securing the armature that does not allow further processing. Since the armature rests against the yoke in the center, the width of the interferric gap is dictated by the distance between a cover-support surface and the face of the armature, by the thickness of the stop, and by the thickness of the armature, and accordingly depends on, among other factors, the mutual tolerance to which the face and the supporting surface can be turned.

The object of the invention is a simple and relatively small articulated-armature magnet system for a matrix printing head that will operate rapidly.

SUMMARY OF THE INVENTION

This object is attained in that the recovery mechanism is another articulated-armature magnet with an armature identical with that of the first but with its yoke mounted on the side of the armature that faces away from the first magnet's yoke. Advantageous embodiments are disclosed herein.

To simplify the design and ensure an interferric gap with a narrow tolerance, the spacer is made out of three stamped and sandwiched blanks of sheet metal. Wider cutouts are preferably stamped into the inner blank of the sandwich to accommodate a pivot on the armature. The articulated armature magnets are mounted in a practical way on a base plate with recesses, and the windings are then slid over them and soldered in place. The light-metal structures are drilled out to accommodate the coils and the base plate. The casting compound is introduced after the magnets have been installed, and the faces and pole surfaces are jointly ground to provide a defined reference surface for assembling the spacers. The spacers can easily be stamped out of blanks of sheet metal with narrow tolerances. Since all the armatures in one head are jigged together into one set and ground before the pivots are inserted, there is only one grinding process, specifically the one that relates to all the interferric-gap widths that dictate the thickness of the armature, which accordingly exhibit practically no difference.

When all the armatures are ground in the same process, it is an advantage to radially taper the pole surfaces of the armatures in relation to the pivots to ensure flat surface-to-surface contact not only at the pole surfaces but also at the surfaces of the stops in order to increase the attenuation and minimize the residual gap. Since the face of the stop that faces the armature is also ground, the interferric gap and hence the stroke traveled by the armature will be dictated by the thickness of the spacer or by the overall thickness of the blanks that comprise it minus the thickness of the armature. This ensures that the flights traveled by the armatures until the pins strike the paper will all be of equal duration, which results in characters that will be precisely up to standard because the site of pin impact will be subject to practically no displacement on the paper in relation to the position that they should occupy with respect to the direction that the head moves in at normal printing speed. The importance of this chronological printing precision increases with the speed of character sequence and to allow a printing-head advance rate of 200 characters per second in a rapid-writing head, which corresponds to an advance of 50 cm/sec. The precise flight of the pins over time and the resulting satisfactory printing quality at a high character speed entails the advantage of high-resolution characters with 24 or 36 pins for example at near letter quality and high speed with a corresponding number of armatures and pins. It is also possible and to advantage to position an additional spring at the recuperation end of the armature to supplement recuperation and braking.

The high-speed printout attainable with the narrow interferric-gap tolerances and with the armature being recuperated with a spring can be accelerated by associating an armature-return mechanism in the form of an electromagnet instead of a spring with each attraction magnet in an articulated armature. The operating magnet must be able to move only the armature and the pin when no current is flowing through the armature-return magnet and to apply sufficient impact energy dot printing. Since the armature-return magnet does not need to be tensioned, an approximately 30% higher printing speed can be attained with the same size components and the same operating conditions.

The armature-return magnets are preferably positioned mirror-inverted in relation to the attraction magnets and they are correspondingly simple to manufacture. When they are inactivated, the pole surfaces of the armature-return magnets act as a stop for the armature. Since less power is needed for return of the armatures because the impact energy of the pins that is not consumed during the printing process causes the pins to rebound, the armature-return magnet can have shorter legs and smaller coils. Since, because the residual gap is very narrow, only a relatively slight number of ampere turns, approximately 2% of the number of turns around the armature-attraction magnets, is necessary to retain the returned armature, the losses that occur in the windings during retention and that are known to depend on the square of the number of ampere turns, will be only about 0.5 per mil.

It is also possible and to advantage to associate a spring or a permanent magnet with the driving or return end of the armature in order to augment activation or return and retention. The non-linear pole-force characteristic of an armature-return magnet can be completely exploited without special expenditure if the pole surfaces of the permanent magnet are processed along with those of the electromagnet during the grinding process, ensuring flat surface contact on the part of the armature. Powerful shearing on the part of the force of the permanent magnet as a result of a wide interferric gap left at the rear in relation to the reflux yoke and created by the armature-return magnet, prevents any noticeable effects on the magnetic force due to fluctuations in temperature.

The armature can be advantageously mounted practically without tension or torsion in relation to the poles of the magnet and to the pins if the pins and/or pivots are welded to the armature in situ, preferably with a laser beam or electron beam. To center the armature precisely in the magnetic field, the electromagnets are advantageously excited with a pulsed current before welding and subjected to a continuous current during welding.

The drawings illustrate advantageous embodiments, wherein:

DETAILED DESCRIPTION OF THE INVENTION

Figure 1:
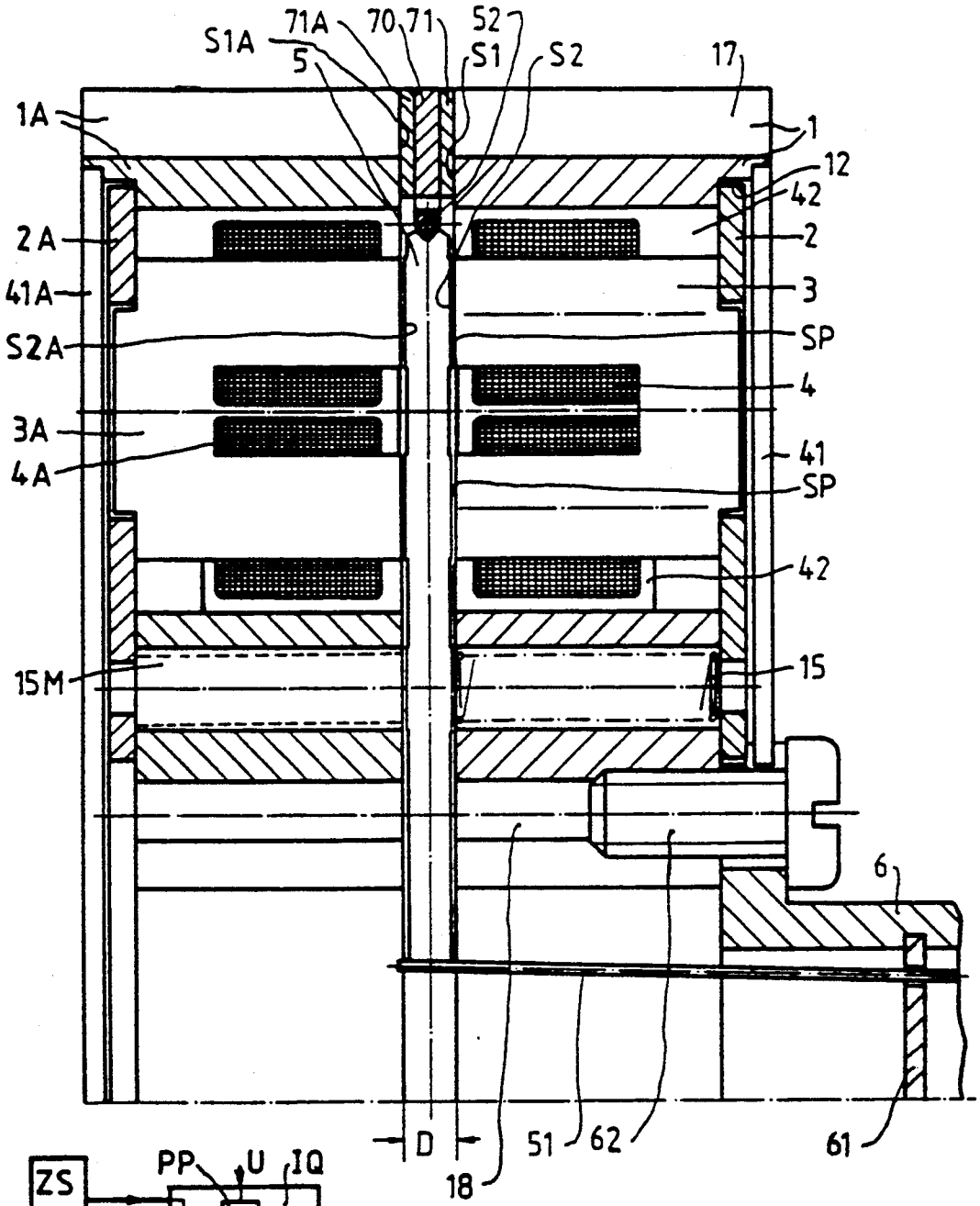
FIG. 1 is a magnified section through a matrix head with armature-return magnets.

FIG. 1 is a section, magnified approximately five times and extending radially out from a midline M, through a matrix printing head with a light-metal structure 1 into which is cast an attraction-magnet yoke 3, on which is mounted a winding 4. Attraction-magnet yoke 3 is accommodated in a recess in a base plate 2. Base plate 2, which accommodates all the attraction magnets along with their windings 4 and electric connections, is secured in a bore 12 in the center of light-metal structure 1. Segmental recesses 42 in light-metal structure 1 are filled with casting compound that dissipates the heat from magnet windings 4. Satisfactory heat dissipation is promoted by cooling fins 17 on the outer surface of light-metal structure 1, and the webs between the magnets also dissipate heat. A casting compound with high heat conductivity is employed, with particles of metal as a filler for example. The face S1 of light-metal structure 1 and the pole surfaces S2 of attraction-magnet yokes 3 are ground in common. Mounted on face S1 is a spacer, including spacers 70, 71 and 71A, in which is articulated an armature 5 surrounded by a lubricant. Secured to the end of armature 5 that extends toward the center of the head is a matrix pin 51. Pins 51 slide back and forth toward an unillustrated printing die in web-shaped channels 61. Pin channels 61 are accommodated in a known way in a housing 6 that is secured by means of screws 62 in cylindrical grooves 18 in light-metal structure 1.

The swing of armature 5 is limited by its impact surfaces, which are ground even with the supporting surface S1A of the armature stop of spacer 71A, 70 and 71. An interferric gap SP for the articulated-armature magnets accordingly derives from the difference between the overall thickness D of the spacer and the thickness of the armature.

An armature-returning mechanism in the form of a return electromagnet 3A and 4A engages armature 5. A compression spring 15 and/or a permanent magnet 15M can also be accommodated in cylindrical openings in metal structure 1 and 1A. Armature-return electromagnets 3A and 4A are positioned symmetrical with respect to armature 5 and mirror-inverted with respect to armature-attraction magnets 3 and 4 and are also secured in a base plate 2A and cast into a light-metal structure IA. The pole surfaces of armature-return magnets 3A constitute armature-stop surfaces S2A. Base plates 2 and 2A are sealed off on the outside by cover plates 41 and 41A.

Figure 2:
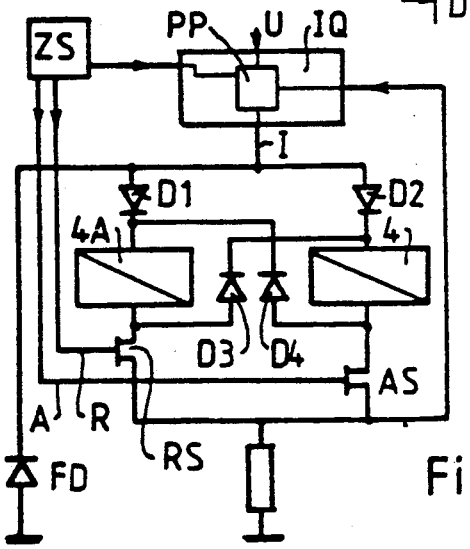
FIG. 2 illustrates a circuit for controlling an attraction magnet and a return magnet.

FIG. 2 illustrates circuitry for controlling the windings of an armature-attraction magnet 4 and of an armature-return magnet 4A. Operating voltage U is supplied to a variable source IQ of current I that in a practical way contains pulse-pause controls PP and an idling circuit FD. Its output terminal can be switched back and forth by way of controllable switches RS and AS to the winding 4A of the armature-returning mechanism or the winding 4 of the activating magnet. Central printing controls ZS emit an activating signal A to switch AS for a prescribed activating time for each point printed, depending on the desired impact strength and on the particular type of paper being printed. Printing controls ZS simultaneously dictate the current intensity of source IQ with a current-intensity control signal or signals IS. An appropriate poled signal R simultaneously opens switch RS and drains the current from armature-return and retention magnet 4A. At the expiration of the activation period, more or less when the pin strikes the paper, control signal A is turned off and signal R turns on the current to the armature-return magnet. It is of advantage for the current to be more or less as intense during the armature-return period as it is during the propulsion period in order to generate more or less the same initial magnetic-field strength in the interferric gap and rapidly reverse the direction that the armature travels in. The result is an essentially lower current intensity due to a change in current-intensity control signals IS, so that, when the armature reaches the stop, it will not rebound but will remain in position and the pin can be activated again either immediately or at any prescribed time with no waiting period.

In one advantageous embodiment of the circuit, the energy from a coil 4 or 4A that has just been disengaged is transferred to the coil that has just been activated at the same instant and that activates the same armature, essentially accelerating the buildup and breakdown of current. The current is allowed to travel from one winding 4 to the other 4A by means of transfer diodes D3 and D4 that constitute a series circuit at alternating ends of the windings, with blocking diodes D1 and D2 disengaging them at opposite ends.

To activate the armature as rapidly as possible and to ensure extensive independence from the saturation property of the magnetic material and especially from its temperature dependence, it is recommended that the ampere turn correspond to approximately 70% of the saturation magnetization of the armature during the attraction phase. Limiting the saturation will also maintain crosstalk from one magnet to another within acceptable limits. In one energy-saving embodiment the ampere turn during the armature-return phase is in a practical way $\frac{1}{3}$ of what it is during the attraction phase. The ampere turn is accordingly decreased to a maintenance ampere turn of approximately 2% of the attraction-phase ampere turn.

An especially rapid resetting of the armature between the two magnets that act on it alternately can be attained when the magnetic fields of both magnets extend rectified through the armature as the result of appropriate polarization of the windings. No switchover-turbulence losses or field-establishment delays will accordingly occur in the armature.

An advantageously energy-saving way of supplying current to armature-return magnets 3A and 4A can be attained by exploiting the rebound energy of matrix pins 51 and armature 5 in that, once the attraction-phase current has been discontinued, which occurs more or less when the pin impacts, there will be a delay during which no current is supplied that lasts until the armature is completely reversed, 10 to 20 microseconds for example, only subsequent to which is current supplied to armature-return magnets 3A and 4A at $\frac{1}{3}$ to 1/10 the attraction-phase ampere turn until armature 5 arrives at the stop and releases its rebound energy in that position, which in that position, which requires approximately $\frac{2}{3}$ to all of the attraction-phase period. The current intensity is then reduced to the maintenance current intensity of approximately 2% of the attraction-phase current intensity. The aforesaid operating ranges relate to the printing of up to five exploitations and of more than five exploitations. Prescription of the appropriate values independent of application is assumed. It is preferable to vary the prescribed values in such a way that they can be switched between two operating situations. When there are more than five exploitations, the maximum attraction-phase ampere turn is employed and, when there are less than five exploitations, the attraction-phase ampere turn is decreased to $\frac{3}{4}$ of the maximum.

Figure 3:
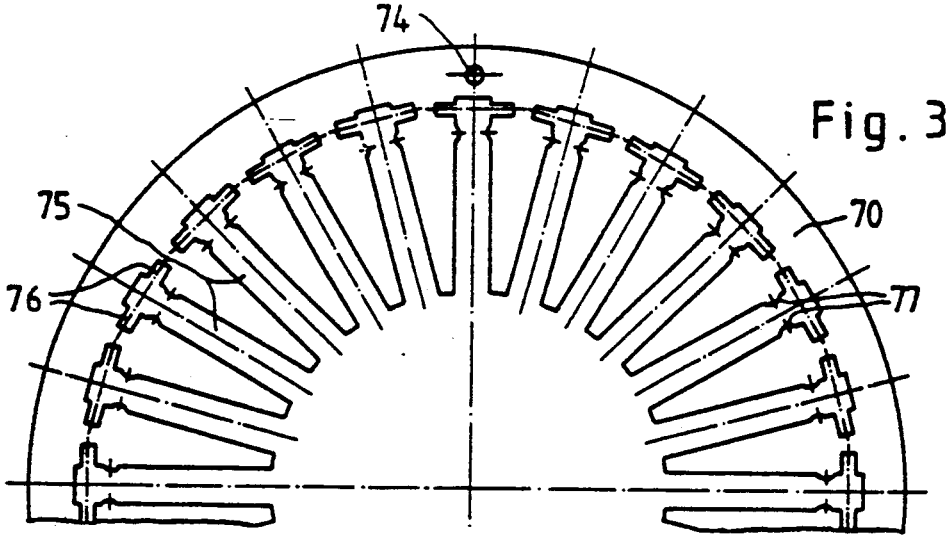
FIG. 3 is a section of a spacer and bearing block.
Figure 4:
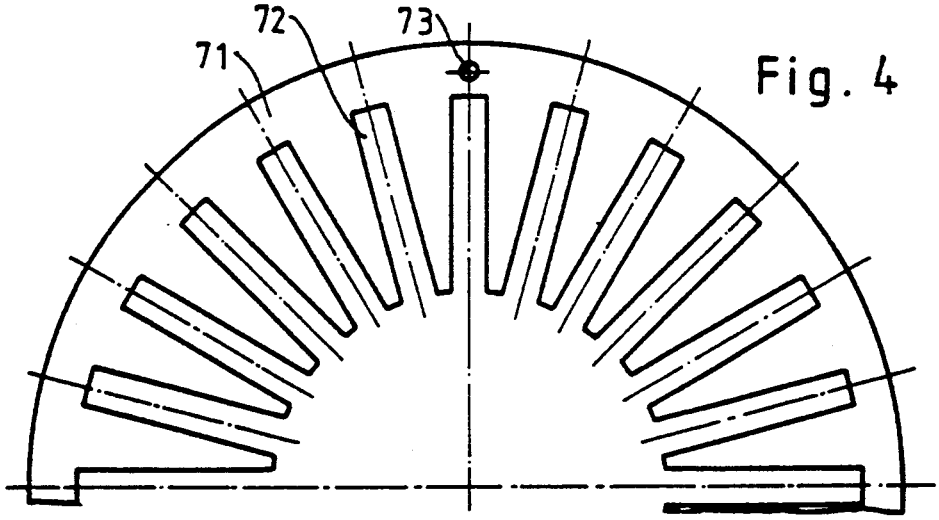
FIG. 4 is a section of a spacer made out of sheet metal.

One advantageous embodiment of a spacer is illustrated in FIG. 3 and 4. FIG. 3 illustrates part of a blank stamped out of thin metal that acts in the capacity of an inner sheet-metal mounting blank 70 and has inwardly segmental cutouts 75 for accommodating the armatures. Segmental cutouts 75 have laterally wider bearing chambers 76 that accommodate the pivots 52 illustrated in FIG. 5. Positioning noses 77 on each side of the vicinity of bearing chambers 76 guide the armatures laterally. Orientation holes 74 make it possible to bolt this component to the other blanks of sheet metal and to the light-metal structure.

FIG. 4 illustrates part of the other sheet-metal spacers 71 that demarcate the position of the pivots on each side of the inner sheet-metal blank, creating extensively closed bearing chambers that are in a practical way filled with permanent lubricant. Segments 72 that allow the armatures to move freely are stamped out of the sheet metal, which also has holes 73 for orienting and bolting.

Figure 5:
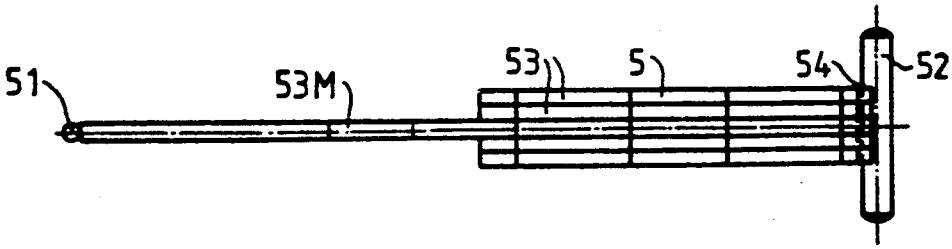
FIG. 5 is a top view of an armature at the same scale as FIG. 1.

FIG. 5 is a top view of an armature 5 sandwiched together from stamped-out blanks 53 and 53M of sheet metal. Inner blank 53M extends to whatever pin-attachment length is most practical, and a matrix pin 51 is welded to its face. Welded into a groove 54 at the opposite end is a pivot 52 in groove 54 in section. The thickness of pivot 52 equals that of the inner blank of sheet metal to close tolerance.

A wedge-shaped armature that tapers in accordance with the angle at which it pivots can also be employed to optimal effect instead of an armature that is uniformly thick in the vicinity of the poles.

What is claimed is:

1. An electromagnetic drive mechanism for a matrix printing head pin, comprising: an articulated armature mounted for articulation at one end and having a free end for acting on a matrix printing head pin and having a longitudinal midplane; and forward mechanism for articulating the armature to move a pin into an engaged position comprising a first electromagnet with an exciter winding and a first yoke on one side of the armature having a pole surface; a return mechanism for articulating the armature to move a pin into a disengaged position, wherein the return mechanism comprises a second electromagnet acting upon the same armature as that of the first electromagnet and with an exciter winding and a second yoke identical to the first yoke and having a pole surface and mounted on a side of the armature facing away form the first yoke of the first electromagnet with the pole surfaces facing each other and wherein the first and second electromagnets are mirror symmetrical about the longitudinal midplane of the armature; and controls to alternate the flow of current through the exciter windings of the first and second electromagnets.

2. An electromagnetic drive mechanism as in claim 1 in combination with matrix printing head having a plurality of electromagnetic drive mechanisms, a matrix of printing head pins, and two parallel base plates having the drive mechanisms and spacers positioned therebetween and determining the distance between the base plates.

3. An electromagnetic drive mechanism as in claim 1 in combination with matrix printing head having a plurality of electromagnetic drive mechanisms, a matrix of printing head pins, and two parallel base plates having the drive mechanisms positioned therebetween and wherein the two base plates are identical in design.

* * * * *